US007959247B2

(12) United States Patent
Suzuki

(10) Patent No.: US 7,959,247 B2
(45) Date of Patent: Jun. 14, 2011

(54) INK-JET PRINTER DEVICE AND INK-JET PRINTING METHOD

(75) Inventor: Kazuo Suzuki, Chiba (JP)

(73) Assignee: Seiko I Infotech Inc. (JP)

( * ) Notice: Subject to any disclaimer, the term of this patent is extended or adjusted under 35 U.S.C. 154(b) by 653 days.

(21) Appl. No.: 12/070,328

(22) Filed: Feb. 14, 2008

(65) Prior Publication Data

US 2008/0204537 A1 Aug. 28, 2008

(30) Foreign Application Priority Data

Feb. 19, 2007 (JP) ..... 2007-038282
Dec. 19, 2007 (JP) ..... 2007-327298

(51) Int. Cl.
*B41J 29/38* (2006.01)

(52) U.S. Cl. ..... 347/16; 347/17; 347/19

(58) Field of Classification Search ..... None
See application file for complete search history.

(56) References Cited

U.S. PATENT DOCUMENTS 3,934,112 A * 1/1976 Lakhani ..... 219/216
2002/0071016 A1 6/2002 Wotton et al. ..... 347/102

FOREIGN PATENT DOCUMENTS

JP 03151239 6/1991
JP 20050125513 5/2005

OTHER PUBLICATIONS

Machine translation of JP 2005-125513 A.*
Translation of JP 03-151239 A.*
Translation of JP 2005-125513 A.*
Patent Abstracts of Japan, publication No. 63317351, publication date Dec. 26, 1988.

* cited by examiner

*Primary Examiner* — Matthew Luu
*Assistant Examiner* — Justin Seo
(74) *Attorney, Agent, or Firm* — Adams & Wilks

(57) ABSTRACT

An ink-jet printer has a print head that performs printing on a print medium transported in a print medium transport direction by scanning in a scanning direction intersecting the print medium transport direction. A platen supports the print medium while the print medium is transported along the print medium transport direction. The platen has heater blocks that become smaller in width in the scanning direction toward both ends of the platen. A measurement section measures a surface temperature of each of portions of the print medium supported by the platen. A calculation section calculates an output value of each of the heater blocks for making the surface temperature of each of the portions of the print medium uniform based on the surface temperature measured by the measurement section. A heater temperature control section controls an output of each of the heater blocks based on the output value calculated by the calculation section.

11 Claims, 6 Drawing Sheets

INK-JET PRINTER DEVICE AND INK-JET PRINTING METHOD

BACKGROUND OF THE INVENTION

1. Technical Field

The present invention mainly relates to an ink-jet printer device and an ink-jet printing method.

2. Background Art

Conventionally, in an ink-jet printer using solvent ink, the solvent ink is discharged onto a medium, which is a print medium, from a print head (hereinafter, referred to as carriage), thereby forming an image. When an increase in printing speed is achieved, before ink discharged during first scanning is sufficiently fixed onto the medium, ink to be discharged during subsequent second scanning is discharged, whereby the ink discharged during the first scanning before fixation and the ink discharged during the second scanning are combined with each other on the medium in some cases. As a result, there arises a problem in that the ink moves on the medium, which leads to deterioration in image quality.

In order to solve the above-mentioned problem, in the conventional printer using solvent ink, as proposed in Japanese Patent Application Laid-open No. HEI 08-207262 and Japanese Patent Application Laid-open No. 2002-11860, for example, a heater for fixing ink is incorporated into a platen to carry out a control for fixing the solvent ink onto the medium in a shorter period of time. Temperature control for the platen is carried out such that a temperature detecting element is mounted to an inner surface of the platen so as to set an output temperature of the temperature detecting element to a constant temperature optimum for the medium.

However, in the prior art, the temperature control for the entire platen is carried out based on data from a single temperature detecting element mounted to the platen, that is, based on a temperature value measured in one section. As a result, the following temperature variations (temperature unevenness) occur.

First temperature unevenness occurs due to the fact that the temperature at ends of the platen becomes lower than that at a center thereof in a case where the platen is uniformly heated.

Second temperature unevenness is temperature unevenness caused in a sheet feed direction, that is, temperature unevenness in which the temperature of the medium on the platen at an upstream of the sheet feed direction becomes lower and the temperature thereof becomes a higher temperature close to a platen temperature toward the downstream thereof.

Third temperature unevenness occurs due to that fact that a difference between the platen temperature and the surface temperature of the medium is not constant because the heat conduction characteristic varies for each kind of the medium, whereby the necessary temperature of the medium surface varies.

Due to the above-mentioned temperature unevenness on the medium surface, there arises a difference in printed dot diameter. This is because, when the temperature of the medium surface is low, it takes time before the discharged ink dries, that is, before the discharged ink is fixed onto the medium, as compared with the portion of the medium surface in which the temperature is high, and an ink diameter is increased during that time. Accordingly, there is a problem in that the ink dot diameter varies for each temperature unevenness of the medium surface, which causes a sense of degradation in image quality.

SUMMARY OF THE INVENTION

In view of the above-mentioned circumstances, the present invention has been made in order to solve the above-mentioned problems, and therefore, it is an object of the present invention to provide an ink-jet printer device capable of making the surface temperature of the print medium uniform, and an ink-jet printing method.

In order to solve the above-mentioned problems, according to the present invention, there is provided at ink-jet printer device, including:

a platen having a heater;

a print head for ejecting ink dots, the print head performing scanning in a direction intersecting a print medium transport direction and ejecting ink dots to a print medium on the platen, thereby performing printing; and heater control means for dividing a portion of the platen, which faces the print head, into a plurality of blocks in the print medium transport direction and in the direction intersecting the print medium transport direction, and for controlling an output of the heater for each of the blocks to thereby perform control for making a surface temperature of the recording medium on a side of the print head in the portion in which the recording medium on the blocks faces the print head uniform.

Further, the ink-jet printer device according to the present invention further including:

measurement means for measuring the surface temperature of a plurality of portions of the print medium on the platen; and averaged output value calculation means for calculating an output value of the heater for making the surface temperature of each of the plurality of portions on the print medium uniform, based on the surface temperature measured by the measurement means, wherein the heater control means controls the output of the heater based on the output value calculated by the averaged output value calculation means.

Further, the ink-jet printer device according to the present invention is an ink-jet printer device including a platen having a heater;

a print head for ejecting ink dots, the print head performing scanning in a direction intersecting a print medium transport direction and ejecting ink dots to a print medium on the platen, thereby performing printing;

measurement means for measuring a surface temperature of each of a plurality of portions of the print medium on the platen; averaged output value calculation means for calculating an output value of the heater for making the surface temperature of each of the plurality of portions on the print medium uniform based on the surface temperature measured by the measurement means; and heater control means for controlling an output of the heater based on the output value calculated by the averaged output value calculation means.

Further, in the ink-jet printer device according to the present invention, the averaged output value calculation means calculates a mean value of the surface temperature of the print medium on the blocks, for each of the divided blocks on the platen, and calculates the output value of the heater contained in the block based on the calculated mean value of the surface temperature for each of the blocks.

Further, in the ink-jet printer device according to the present invention, the blocks become smaller in width in a scanning direction toward both ends of the platen.

Further, in the ink-jet printer device according to the present invention, the blocks become larger in width in the print medium transport direction toward a downstream of the print medium transport direction.

Further, in the ink-jet printer device according to the present invention, the blocks are divided based on a temperature distribution obtained by measuring a surface temperature on the print medium.

Further, in the ink-jet printer device according to the present invention, the measurement means is provided at a position passing near a center of a transport direction of the blocks arranged in the scanning direction.

Further, the present invention provides an ink-jet printing method for an ink-jet printer device including a platen having a heater, and a print head for ejecting ink dots, the print head performing scanning in a direction intersecting a print medium transport direction and ejecting ink dots to a print medium on the platen to perform printing, including:

a measurement step of measuring a surface temperature of each of a plurality of portions of the print medium on the platen;

an averaged output value calculation step of calculating an output value of the heater for making the surface temperature of each of the plurality of portions on the print medium uniform based on the measured surface temperature; and a heater control step of controlling an output of the heater based on the calculated output value.

Further, in the ink-jet printer device according to the present invention, the heater control means controls supply power per unit area of the blocks so that the supply power for the heater in the block positioned upstream of the transport direction becomes larger than that for the heater in the block positioned downstream of the transport direction, and the supply power for the heater in the block positioned at a center of the direction intersecting the transport direction becomes smaller than that for the heater in the block positioned in a direction apart from the center of the direction intersecting the transport direction.

Further, in the ink-jet printer device according to the present invention, a size of each of the blocks is set so that the block positioned upstream of the transport direction becomes shorter in the transport direction than the block positioned downstream of the transport direction and the block positioned at the center of the direction intersecting the transport direction becomes longer in the direction intersecting the transport direction than the block positioned in the direction apart from the center of the direction intersecting the transport direction, and the heater control means performs control for outputting electric power corresponding to a predetermined value to the heater in each of the blocks.

According to the present invention, the ink jet printer device including a platen having a heater; a print head for ejecting ink dots, the print head performing scanning in a direction intersecting a print medium transport direction and ejecting ink dots to a print medium on the platen, thereby performing printing, is provided with measurement means for measuring a surface temperature of each of a plurality of portions of the print medium on the platen; averaged output value calculation means for calculating an output value of the heater for making the surface temperature of each of the plurality of portions on the print medium uniform based on the surface temperature measured by the measurement means; and heater control means for controlling an output of the heater based on the output value calculated by the averaged output value calculation means.

With this, the heater output value for making the surface temperature of the print medium uniform is calculated based on the surface temperature of each of the plurality of portions of the print medium, and the output of the heater can be controlled based on the calculated heater output value. As a result, there is an effect in that the temperature unevenness on the surface of the print medium can be reduced irrespective of the temperature conduction characteristic of the print medium. Accordingly, since fixing conditions of the ink on the entire print medium become constant, it is possible to eliminate the factors for degradation of image quality, such as the difference in dot diameter depending on the position of the print medium and an ink flow generated in a region in which the temperature is lowered, and there is an effect in that the image quality of the ink-jet printer using solvent ink is improved.

Further, according to the present invention, the averaged output value calculation means of the ink-jet printer device calculates a mean value of the surface temperature of the print medium on the blocks, for each of the divided blocks on the platen, to calculate the output value of the heater contained in the block based on the calculated mean value of the surface temperature for each of the blocks.

Accordingly, instead of controlling the heater uniformly on the entire platen, the temperature can be controlled separately for each block on the platen. As a result, in the region of each block, the temperature can be separately controlled so that the surface temperature of the print medium becomes the set temperature, thereby making it possible to reduce the variation in temperature depending on the position on the platen. When the variation in temperature of the media depending on the position on the platen is reduced, the fixing conditions of the ink on the entire print medium become constant. For this reason, it is possible to eliminate the factors for the degradation of image quality, such as the difference in dot diameter depending on the position of the print medium and the ink flow generated in the region in which the temperature is lowered, and there is an effect in that the image quality of the ink-jet printer using solvent ink is improved.

Further, according to the present invention, the blocks of the ink-jet printer device become smaller in width in a scanning direction toward both ends of the platen.

Accordingly, there is an effect in that the heater included in the platen can be controlled based on a gradient of a temperature change in the scanning direction, that is, a characteristic in which the temperature falls toward the both ends of the platen.

Further, according to the present invention, the blocks of the ink-jet printer device become larger in width in the print medium transport direction toward a downstream of the print medium transport direction.

Accordingly, there is an effect in that the heater included in the platen can be controlled based on a gradient of a temperature change in the print medium transport direction, that is, a characteristic in which the temperature rises toward the downstream of the print medium transport direction.

Further, according to the present invention, the blocks of the ink-jet printer device are divided based on a temperature distribution obtained by measuring a surface temperature on the print medium.

Accordingly, there is an effect in that the heater included in the platen can be controlled based on a gradient of a measured temperature change of the print medium, that is, a temperature distribution of the surface temperature, and an effective temperature control can be performed.

Further, according to the present invention, the measurement means of the ink-jet printer device is provided at a position passing near a center of a transport direction of the blocks arranged in the scanning direction.

Accordingly, there is an effect in that a substantial center of the gradient of the surface temperature of the print medium in each block is measured, thereby making it possible to measure a value approximate to a mean value of the surface temperature of the print medium for each block.

DETAIL DESCRIPTION OF THE PREFERRED EMBODIMENTS

Hereinafter, an ink-jet printer device 100 according to an embodiment of the present invention will be described with reference to the drawings.

Figure 1:
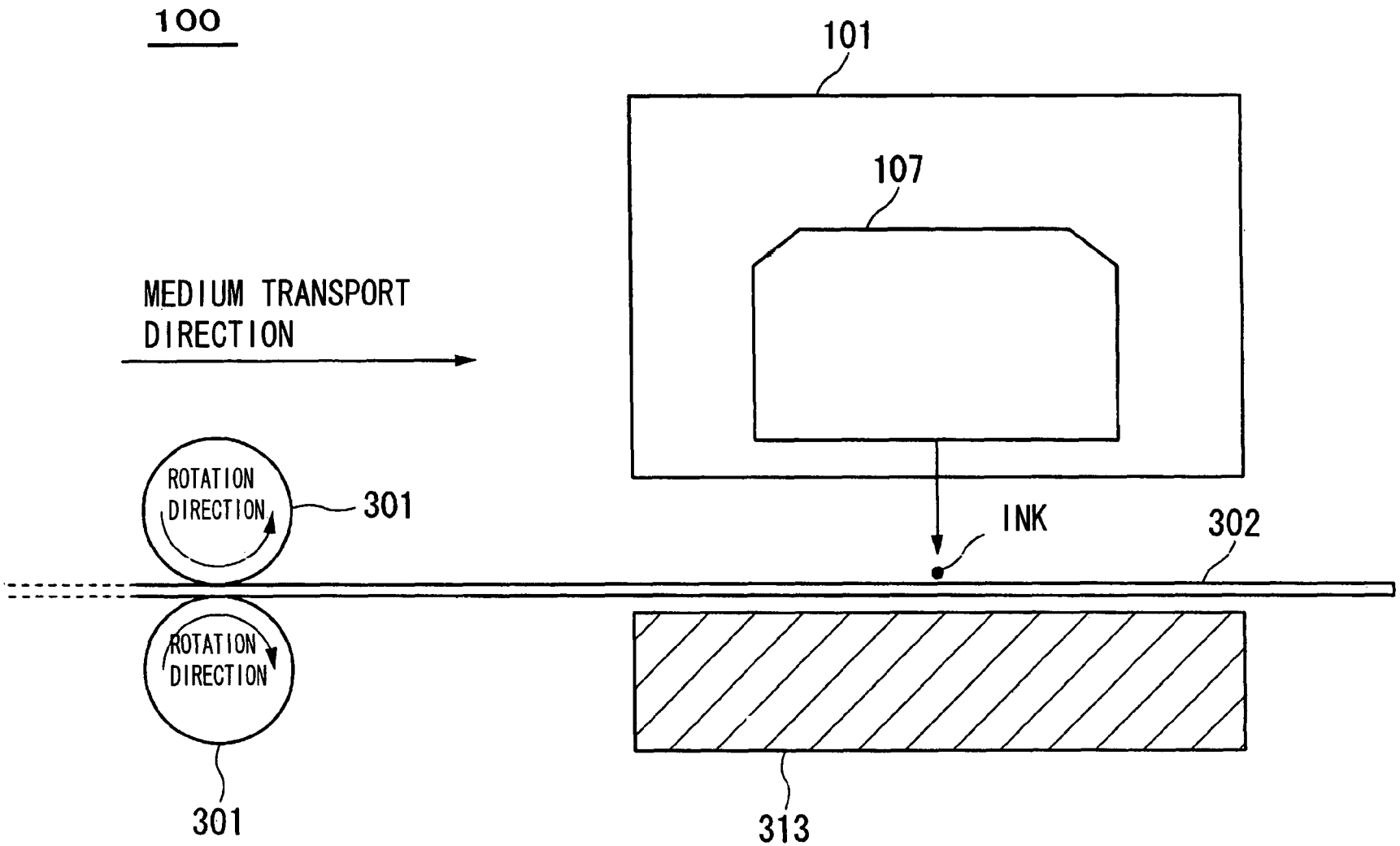
FIG. 1 is a diagram showing an entire structure of an ink-jet printer device 100 according to an embodiment of the present invention at the time of printing.

FIG. 1 is a schematic block diagram of the ink-jet printer device 100 according to this embodiment when viewed from a side surface thereof at the time of printing.

Two medium feeding parts 301 each have a cylindrical shape, and the two medium feeding parts 301 nip a medium which is a print medium, and the medium feeding parts 301 rotate while nipping the medium, thereby transporting the medium. Note that a medium 302 is, for example, a print medium such as paper.

A carriage 101 serves as a print head including ink heads for six colors of cyan (C), magenta (M), yellow (Y), light cyan (Lc), light magenta (Lm), and black (Bk), and ejects ink while performing scanning in a medium transport direction, that is, a direction intersecting a medium feed direction, thereby performing printing.

A platen 313 serves as a medium support member including a plurality of heaters inside thereof, for heating the medium.

In FIG. 1, the medium feeding part 301 transports the medium 302 which is a print medium, from left to right of the figure. In this case, the medium is printed on the platen 313 with ink ejected from a Bk head 107 which is a head for Bk ink and included in the carriage 101.

Next, an internal structure of the ink-jet printer device 100 will be described.

Figure 2:
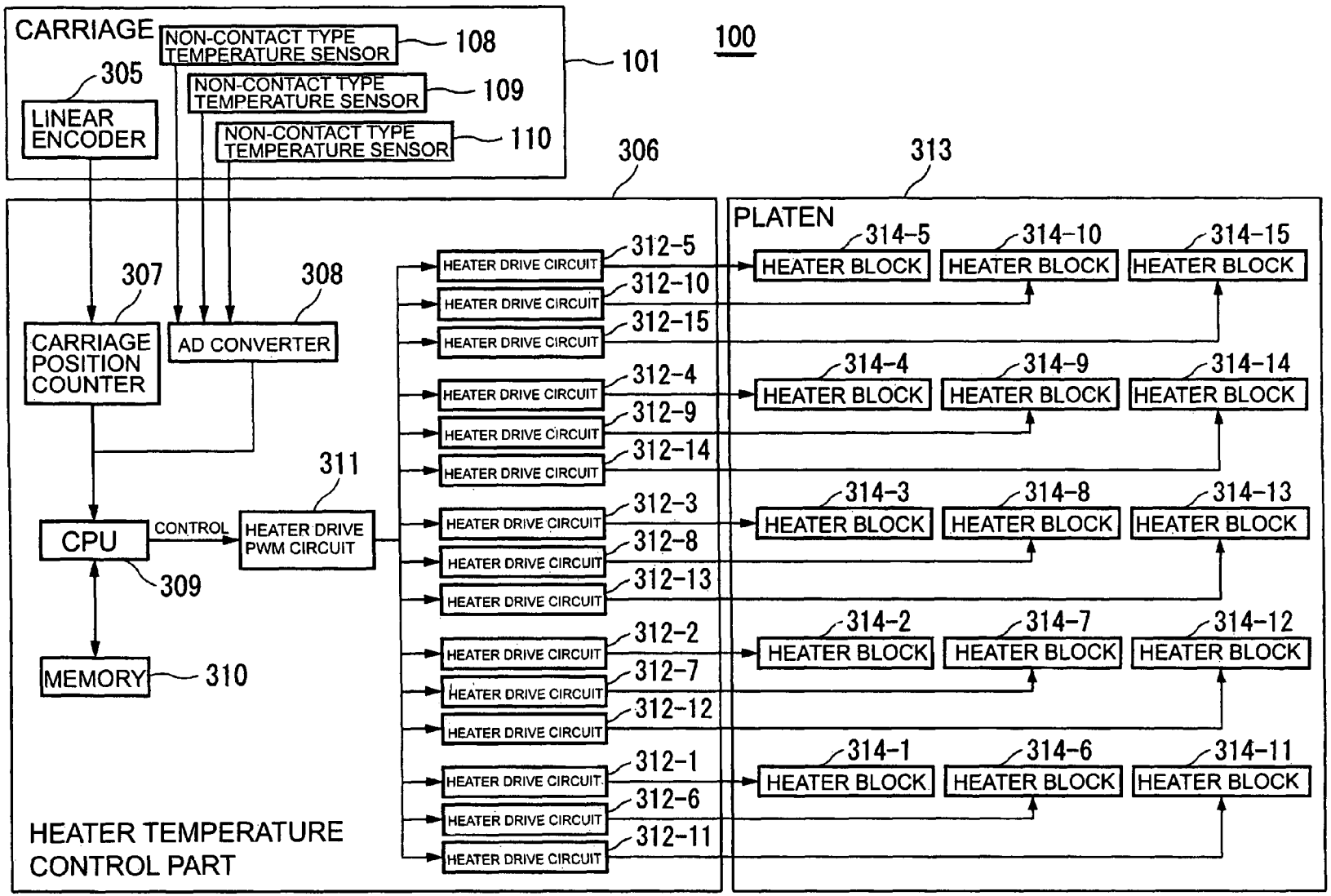
FIG. 2 is a block diagram showing an internal structure of the ink-jet printer device 100 according to the embodiment of the present invention.

FIG. 2 is a block diagram showing the structure of the ink-jet printer device 100. The ink-jet printer device 100 includes the carriage 101, a heater temperature control part 306, and the platen 313.

Figure 3:
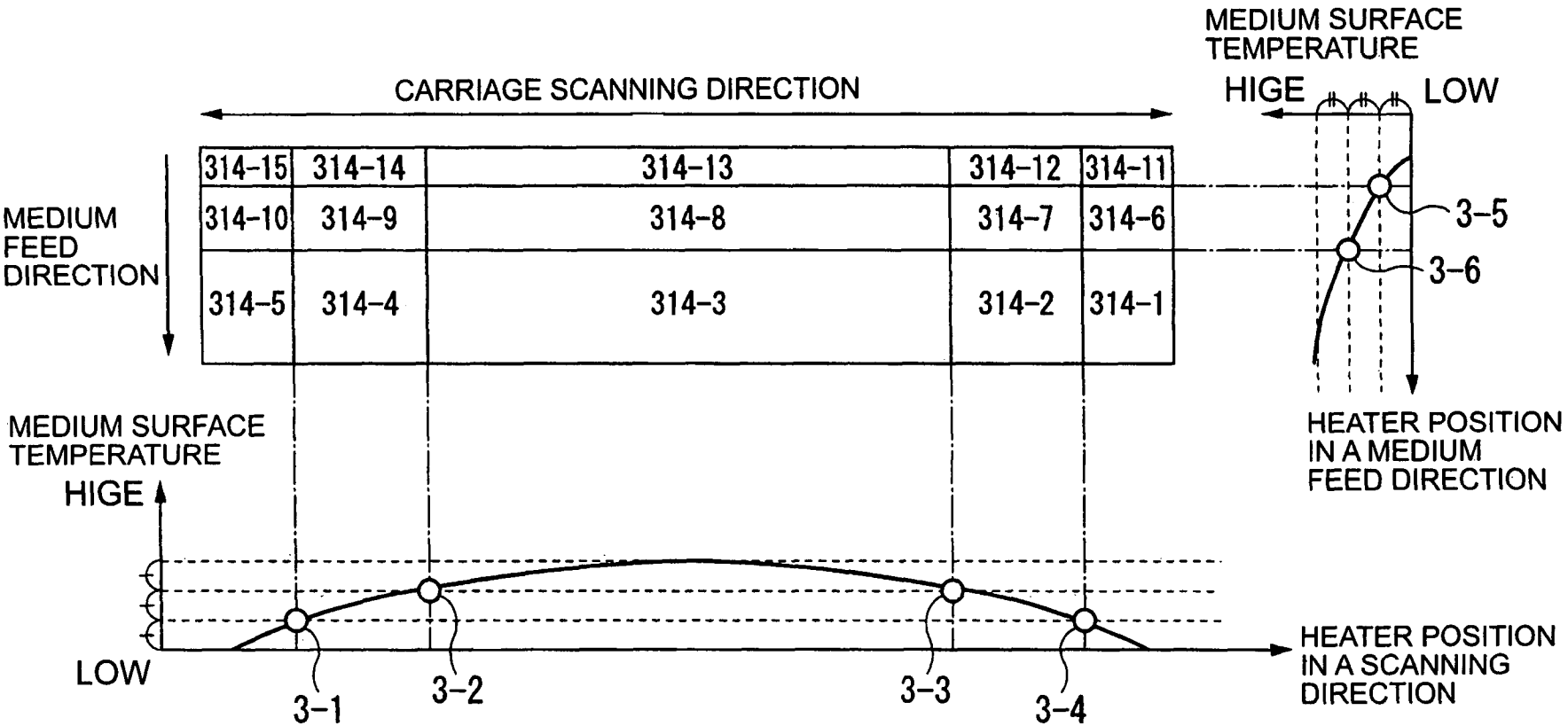
FIG. 3 is a diagram showing a method of dividing a platen 313 according to the embodiment of the present invention.

The platen 313 includes heater blocks 314-1 to 314-15 for heating the medium. FIG. 3 shows positions of the heater blocks 314-1 to 314-15 of the platen 313, divided areas of the heater blocks, and shows a graph which is a temperature distribution curve of a surface of the medium 302 in a case where the heater blocks 314-1 to 314-15 are uniformly heated. In this embodiment, a description is given of an example where the platen 313 is divided into three blocks in the medium feed direction, and is divided into five blocks in a scanning direction of the carriage 101, to be divided into 15 blocks in total, whereby the heater is controlled for each block.

In this embodiment, a description is given of a case where, in the platen 313, the division into heater blocks is not performed at regular intervals both in vertical and horizontal directions. For example, because the medium 302 is deprived of heat by the medium feeding part 301 of FIG. 1 and the like, and the medium, which is deprived of heat, itself lowers the temperature of the platen 313, as shown in the graph showing the surface temperature of FIG. 3, the temperature of a portion on the platen 313, which is near the medium feeding part 301, decreases nonlinearly. Therefore, as shown in FIG. 3, the platen is divided in the medium feed direction so as to become wider toward a downstream of the medium feed direction.

In this case, as a method of determining dividing positions, there is employed a method of determining, as the dividing positions, positions where temperature difference values of the surface temperature of the medium on each of the heater blocks become equal to each other, based on the temperature distribution curve of the surface of the medium 302 when the printing is carried out while the heater blocks 314-1 to 314-15 are uniformly heated. In other words, based on the temperature distribution curve of FIG. 3 showing the surface temperature of the medium in the medium feed direction, in the medium feed direction, heater positions in the medium feed direction, which correspond to reference numeral 3-5 at which a value that is one-third of a value of a maximum temperature intersects the temperature distribution curve, and reference numeral 3-6 at which a value that is two-thirds of the value of the maximum temperature intersects the temperature distribution curve, respectively, are determined as the dividing positions of the platen 313.

Further, in the scanning direction of the carriage 101, as shown in FIG. 3, the surface temperature of the medium decreases toward both ends of the platen 313. Accordingly, in the same manner as in the medium feed direction, the dividing positions in the scanning direction of the carriage are also determined in such a manner that, based on the temperature distribution curve of FIG. 3 showing the surface temperature of the medium in the scanning direction of the carriage 101, in the scanning direction of the carriage 101, heater positions in the scanning direction of the carriage 101, which correspond to reference numerals 3-1 and 3-4 at each of which a value that is one-third of the value of the maximum temperature intersects the temperature distribution curve, and reference numerals 3-2 and 3-3 at each of which a value that is two-thirds of the value of the maximum temperature intersects the temperature distribution curve, respectively, are determined as the dividing positions of the platen 313.

By the above-mentioned method of division, the platen 313 is divided into the heater blocks, whereby the difference between a maximum value of the surface temperature and a minimum value thereof in each block is made uniform. Accordingly, the surface temperature of the medium can be controlled with efficiency.

Returning to FIG. 2, the carriage 101 includes, in addition to the ink heads, a linear encoder 305 and non-contact type temperature sensors 108 to 110. The linear encoder 305 measures a displacement in the scanning direction of the carriage 101, and outputs measured displacement data as a displacement signal to a carriage position counter 307. The linear encoder 305 is, for example, a sensor for measuring a parallel movement distance optically, magnetically, or the like.

The non-contact type sensors 108 to 110 each are, for example, a radiation thermometer for measuring an amount of energy of a infrared ray to be radiated from a surface of an object to convert the amount of energy into a temperature value, and each are a sensor for measuring the surface temperature of the medium 302 on the platen 313. The non-contact type temperature sensors 108 to 110 each output a measured voltage value to an AD converter 308.

Figure 4:
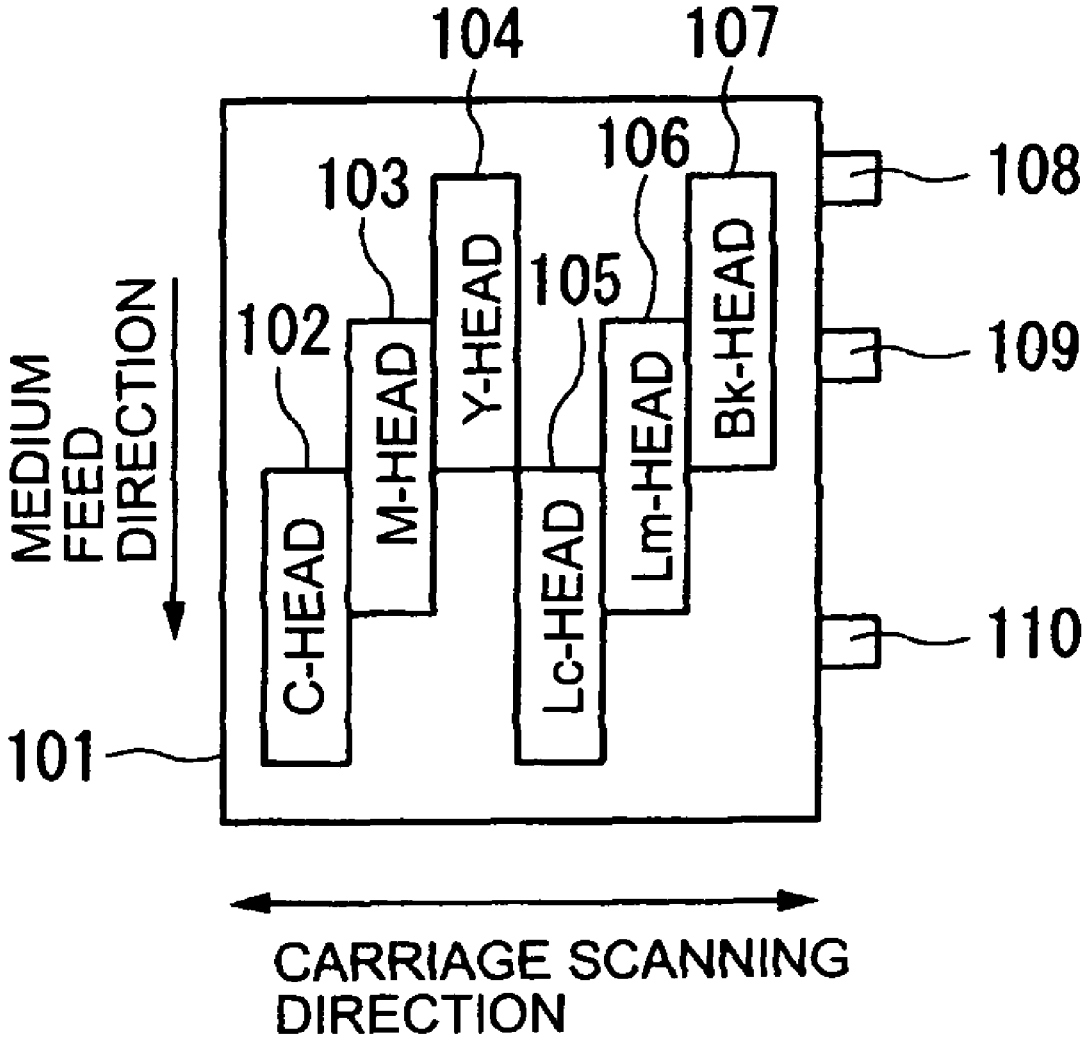
FIG. 4 is a diagram showing a structure of a carriage 101 according to the embodiment of the present invention.
Figure 5:
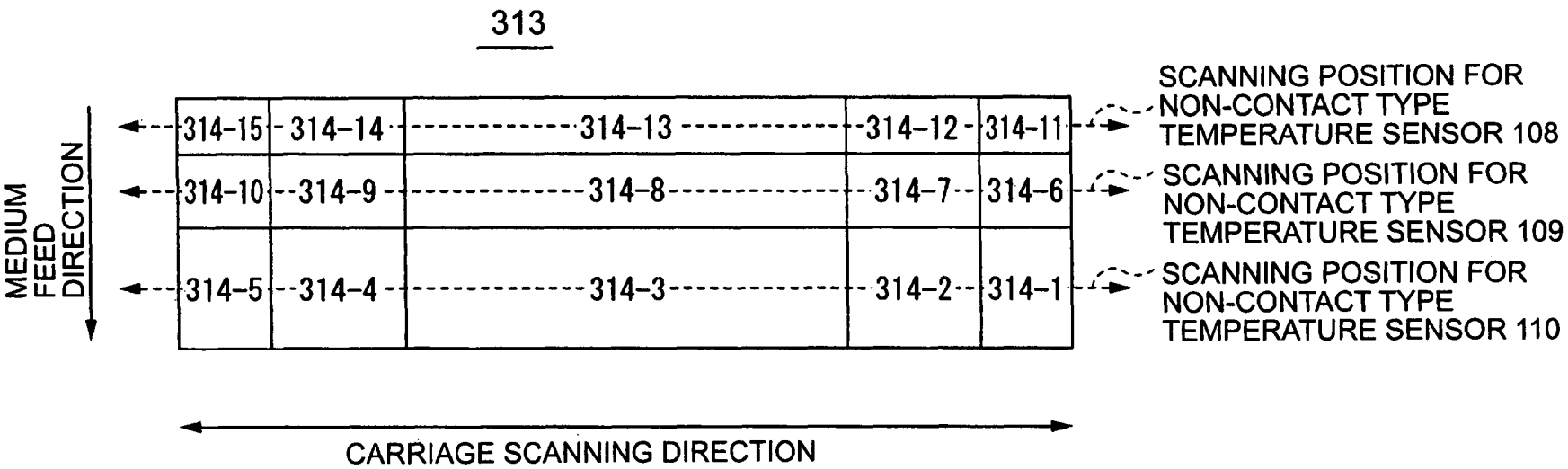
FIG. 5 is a diagram showing positions of non-contact type temperature sensors 108 to 110 according to the embodiment of the present invention in the carriage 101.

FIGS. 4 and 5 each show installation positions of the non-contact type temperature sensors 108 to 110 in the carriage 101. As shown in FIG. 4, the non-contact type temperature sensors 108 to 110 are provided in the medium feed direction in the carriage 101. Moreover, as shown in FIG. 5, the non-contact type temperature sensors 108 to 110 are provided to the carriage 101 so that a scanning position for each of the non-contact type temperature sensors 108 to 110 is set to a center position in a sheet feed direction of each of the divided blocks. In other words, in the medium feed direction, the non-contact type temperature sensor 108 is provided at a position passing through the center of each of the heater blocks 314-11 to 314-15, the non-contact type temperature sensor 109 is provided at a position passing through the center of each of the heater blocks 314-6 to 314-10, and the non-contact type temperature sensor 110 is provided at a position passing through the center of each of the heater blocks 314-1 to 314-5.

Returning to FIG. 2, the heater temperature control part 306 includes the carriage position counter 307, the analog digital (AD) converter 308, a central processing unit (CPU)-309, a memory 310, a heater drive pulse width modulation (PWM) circuit 311, and heater drive circuits 312-1 to 312-15.

The carriage position counter 307 counts displacement signals in the scanning direction of the carriage 101 inputted from the linear encoder 305 of the carriage 101, and outputs a counted value as positional information about the carriage 101 to the CPU 309.

The AD converter 308 performs AD conversion of the measured voltage value inputted from each of the non-contact type temperature sensors 108 to 110 of the carriage 101, and inputs the measured value, which is converted into a digital value, to the CPU 309.

The memory 310 stores identification information imparted to each of the heater blocks 314-1 to 314-15 in advance, and positional information about each of the heater blocks corresponding to the identification information, so as to be associated with each other, as block positional information. Further, the memory 310 stores an optimum temperature value of the surface temperature of the medium in advance.

The CPU 309 calculates a temperature distribution of the medium on the platen 313 based on the positional information in the scanning direction of the carriage 101, which is inputted from the carriage position counter 307, and based on the information on surface temperature values measured by each of the non-contact type temperature sensors 108 to 110, which is inputted from the AD converter 308.

Based on the calculated temperature distribution, the CPU 309 calculates an output value of each of the heater blocks 314-1 to 314-15 so that the surface temperature of the medium on the platen 313 is uniformly set to the optimum temperature value of the surface temperature of the medium which is stored in the memory 310. The CPU 309 outputs to the heater drive PWM circuit 311 a heater output control signal containing the identification information about each of the heater blocks 314-1 to 314-15 and the output value of each of the heater blocks corresponding to the calculated identification information.

The heater drive PWM circuit 311 outputs a heater drive signal to each of the heater drive circuits 312-1 to 312-15 in response to the heater output control signal inputted from the CPU 309.

The heater drive circuits 312-1 to 312-15 drive the heater blocks 314-1 to 314-15 of the platen 313, respectively, in response to the heater drive signal inputted from the heater drive PWM circuit 311.

Figure 6:
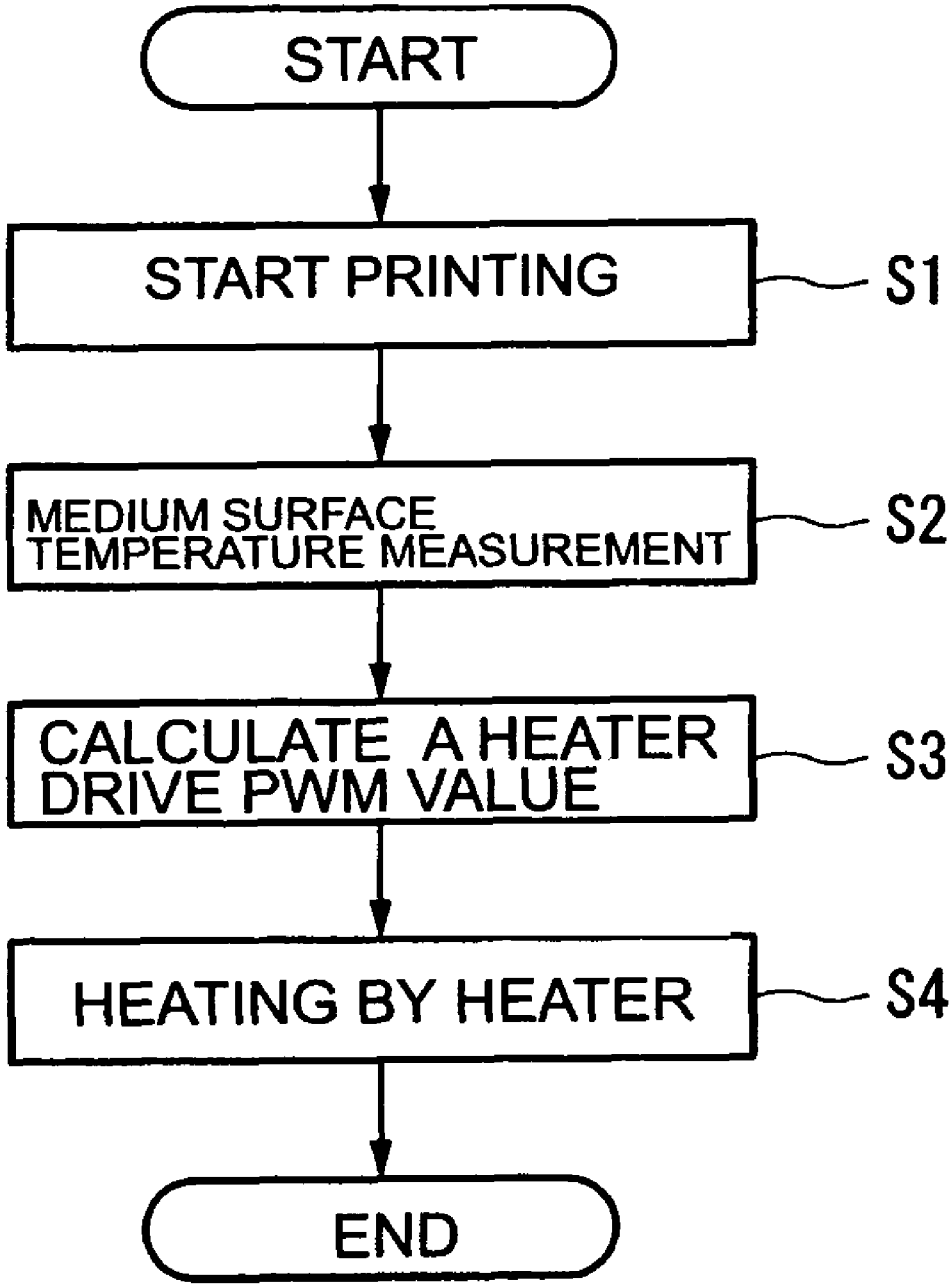
FIG. 6 is a flowchart showing an operation flow of the ink-jet printer device 100 according to the embodiment of the present invention.

Next, a description is given of operations of the ink-jet printer device 100 according to an embodiment of the present invention. FIG. 6 is a flowchart showing a flow of processing operations for making the surface temperature of the medium uniform in the ink-jet printer device 100.

In the ink-jet printer device 100, when the printing is started, the medium feeding part 301 transports the medium 302 which is a print medium, and the carriage 101 ejects ink while performing scanning in the direction intersecting the medium feed direction, thereby starting the printing (Step S1).

In the carriage 101, the non-contact type temperature sensors 108 to 110 each measure the surface temperature of the medium 302 on the platen 313 as needed during the scanning by the carriage 101, and each output the measured surface temperature value to the CPU 309 via the AD converter 308.

Simultaneously, the linear encoder 305 outputs the displacement signal, which indicates the displacement of the carriage 101, to the carriage position counter 307, and the carriage position counter 307 outputs the positional information in the scanning direction of the carriage 101 to the CPU 309 in response to the inputted displacement signal (Step S2).

The CPU 309 calculates an average temperature value for each of the heater blocks based on the positional information and the surface temperature values which are simultaneously inputted, and the block positional information stored in the memory 310.

The CPU 309 calculates a heater drive PWM value which is the output value of each of the heater blocks 314-1 to 314-15, for each of the heater blocks 314-1 to 314-15, based on a value of the temperature difference between the calculated average temperature value and the optimum temperature value of the surface temperature of the medium which is stored in the memory 310 in advance. In this case, the heater drive PWM value is a value obtained when the surface temperature of the medium in the block becomes the optimum temperature value stored in the memory 310. Further, a relation between a width of the temperature to be increased and the heater drive PWM value is stored in the memory 310 or the like in advance.

The CPU 309 outputs, to the heater drive PWM circuit 311, the calculated heater drive PWM value as the heater output control signal containing the block identification information and the heater drive PWM value corresponding to the block identification information (Step S3).

The heater drive PWM circuit 311 outputs the heater drive signal to each of the heater drive circuits 312-1 to 312-15 in response to the heater output control signal inputted from the CPU 309, and the heater drive circuits 312-1 to 312-15 drive the heater blocks 314-1 to 314-15 of the platen 313, respectively, in response to the heater drive signal inputted from the heater drive PWM circuit 311 (Step S4).

In the above embodiment, the non-contact type temperature sensors 108 to 110 each measure the surface temperature of the medium 302 on the platen 313 for each of the heater blocks, and control the output value of each of the heater blocks 314-1 to 314-15 based on unevenness of the surface temperature distribution calculated by the CPU 309 from the measured surface temperature. Accordingly, there is an effect in that, in the distribution of the surface temperature of the medium 302 to be subsequently fed onto the platen 313 by the medium feeding part 301, the surface temperature of the medium 302 is made more uniform than in the temperature distribution originally measured by each of the non-contact type temperature sensors 108 to 110.

Therefore, degradation in image quality due to the temperature unevenness can be reduced, with the result that there can be provided printing with higher image quality also in a large ink-jet printer, as compared with the conventional case.

Further, even in a case where media have different heat conduction characteristics, when the surface temperature of the medium is measured, and the surface temperature is made uniform by each of the heater blocks 314-1 to 314-15 based on the temperature distribution of the measured surface temperature, there is an effect in that the surface temperature of the medium can be made uniform irrespective of the heat conduction characteristic of the medium.

Note that, in this embodiment, the platen 313 is divided into three blocks in the medium feed direction, and is divided into five blocks in the scanning direction of the carriage 101, to be divided into 15 blocks in total. Alternatively, the platen 313 may be divided into M blocks (note that M is an integer equal to or larger than 1) in the medium feed direction, and may be divided in N blocks (note that N is an integer equal to or larger than 1) in the scanning direction of the carriage 101, to be divided into blocks corresponding to a value obtained by multiplying M by N, that is, M×N blocks.

At this time, on the carriage 101, there are provided M numbers of non-contact type temperature sensors for measuring the surface temperature of the medium, in the medium feed direction. There is employed a structure in which each of the temperature sensors reads the surface temperature of the medium on the platen during the printing. The heaters for heating the platen divided into M×N blocks in a main scanning direction (carriage scanning direction) and in a sub-scanning direction (medium feed direction) are structured to be separately driven.

A control program allows calculation of the average surface temperature of each of the heater blocks, which are divided into M×N blocks, based on the above-mentioned output value of the each of the temperature sensors. The CPU 309 calculates the output value of each of the heater blocks in each portion so that each of the heater blocks is set to a set temperature, and controls the heater blocks based on the calculated output value of each of the heater blocks.

Accordingly, it is possible to eliminate the temperature unevenness which occurs when the platen 313 is uniformly heated due to the fact that the temperature at the ends of the platen 313 becomes lower than that at the center thereof, and the temperature unevenness caused in the sheet feed direction, that is, the temperature unevenness in which the temperature of the medium 302 on the platen becomes lower at the upstream of the sheet feed direction and becomes a higher temperature close to a platen temperature toward the downstream thereof. As a result, there is an effect capable of making the surface temperature of the medium 302 uniform by the use of the heater with the blocks which are divided based on the temperature distribution in the case where the temperature unevenness occurs.

Note that the print medium transport direction described in the present invention corresponds to the medium feed direction, and the print medium described in the present invention corresponds to the medium. The output value of the heater described in the present invention corresponds to the heater drive PWM value, and the center in the transport direction of the each of the blocks in parallel with the scanning direction, which is described in the present invention, corresponds to the center position in the sheet feed direction of each of the divided blocks.

Further, a program for realizing the steps shown in FIG. 6 may be recorded on a computer readable recording medium, and a computer system may be caused to read and execute the program recorded on the recording medium, to thereby perform processing of controlling the output value of each of the heater blocks 314-1 to 314-15 for making the surface temperature of the medium on the platen 313 uniform. Note that the "computer system" described herein may include hardware such as an OS and peripheral equipment.

Further, the "computer system" includes a homepage providing environment (or display environment) in a case where a WWW system is used.

Further, the "computer readable recording medium" refers to a writable nonvolatile memory such as a flexible disk, a magneto-optical disk, a ROM, and a flash memory, a portable medium such as a CD-ROM, and a memory device such as a hard disk incorporated in a computer system.

In addition, the "computer readable recording medium" includes a medium storing a program for a predetermined time period, such as a volatile memory (for example, dynamic random access memory (DRAM)) incorporated in the computer system which becomes a server or a client in a case where the program is transmitted via a network such as the Internet, or a communication line such as a telephone line.

Further, the above-mentioned program may be transmitted from the computer system which stores the program in the memory device or the like via a transmission medium, or may be transmitted by a transmitted wave through the transmission medium to another computer system. In this case, the "transmission medium" for transmitting the program refers to a medium having a function for transmitting information like a network (communication network) such as the Internet, or a communication line (communication wire) such as a telephone line.

Further, the above-mentioned program may be a program for realizing a part of the above-mentioned function. Moreover, there may be used a program that can realize the above-mentioned function by a combination of a program already recorded in the computer system, that is, a so-called differential file (differential program).

Other Embodiments

Differences from the above embodiment will be described. A heater output value of each block of the platen 313 according to an ambient temperature and a kind of the print medium is stored in the memory 310 in advance. A heat discharge varies depending on the kind of the print medium. The heater output value of each block for optimizing the surface temperature of the print medium is obtained for each print medium and each ambient temperature through an experiment in advance, and the obtained data is stored in the memory 310.

In actual printing, the ambient temperature is measured, and the CPU 309 controls the heater drive PWM circuit 311 so as to obtain an optimum heater output value in the recording medium, which is stored therein in advance. In the measurement of the ambient temperature, the temperature of an unheated portion is measured, whereby the non-contact type temperature sensor can be used. Further, in the above embodiment, data may be stored by storing, in the memory, control results of the heater output value of each block based on the value which is obtained when the surface temperature of the print medium is measured by the non-contact type temperature sensor.

In those embodiments, when the platen is uniformly heated, heat radiation from the platen increases at the upstream of the transport direction of the print medium, and decreases toward the downstream thereof. Accordingly, electric power applied to the heater is reduced at the upstream of the transport direction of the print medium, and the electric power applied to the heater is increased toward the downstream. Further, the heat radiation decreases at the center of the print medium and increases toward the ends thereof. Accordingly, the electric power applied to the heater is reduced at the center of the print medium, and the electric power applied to the heater is increased toward the ends thereof. Note that the electric power applied to the heater is compared with electric power to be applied to each predetermined area of the platen, for example, per unit area. The above description is made on the electric power applied to the heater, which is more accurately a calorific value of the heater. In this case, the description is made assuming that the electric power applied to the heater and the calorific value of the heater are in a correspondence relation.

By changing the electric power applied to the heater by control means, the surface temperature of the print medium can be made uniform. The surface temperature is measured by the non-contact type temperature sensor to control the heater temperature based on the measured value, whereby the surface temperature of the print medium can be made uniform more accurately.

What is claimed is:

1. An ink-jet printer, comprising:

a platen for supporting a print medium during movement of the print medium along a print medium transport direction, the platen having a heater;

a print head disposed in confronting relation to the platen for performing scanning in a direction intersecting the print medium transport direction and for ejecting ink dots to the print medium while the print medium is supported by the platen to thereby perform printing on the print medium, heater control means for dividing a portion of the platen into a plurality of blocks in the print medium transport direction and in a direction intersecting the print medium transport direction such that the blocks become smaller in width in a scanning direction toward both ends of the platen, and for controlling an output of the heater for each of the blocks to thereby perform control for making a surface temperature of the print medium uniform, measurement means for measuring the surface temperature of a plurality of portions of the print medium supported by the platen; and averaged output value calculation means for calculating an output value of the heater for making the surface temperature of each of the plurality of portions of the print medium uniform based on the surface temperature measured by the measurement means, the heater control means controlling the output of the heater based on the output value calculated by the averaged output value calculation means.

2. An ink-jet printer device according to claim 1; wherein the averaged output value calculation means calculates a mean value of the surface temperature of the print medium on the blocks for each of the divided blocks and calculates the output value of the heater based on the calculated mean value of the surface temperature for each of the blocks.

3. An ink-jet printer device according to claim 1; wherein the measurement means is provided at a position passing near a center of a transport direction of the blocks arranged in the scanning direction.

4. An ink-jet printer device according to claim 1; wherein the heater control means divides the portion of the platen into the plurality of blocks based on a temperature distribution of the surface temperature of the plurality of portions of the print medium measured by the measurement means.

5. An ink-jet printer device according to claim 4; wherein the measurement means is provided at a position passing near a center of a transport direction of the blocks arranged in the scanning direction.

6. An ink-jet printer device according to claim 1; wherein the heater control means controls the output of the heater for each of the blocks so that the output of the heater for the block positioned upstream of the transport direction becomes larger than that for the heater in the block positioned downstream of the transport direction, and the output of the heater for the block positioned at a center of the direction intersecting the transport direction becomes smaller than that for the block positioned in a direction apart from the center of the direction intersecting the transport direction.

7. An ink-jet printer device according to claim 1; wherein one of the blocks positioned upstream of the transport direction is shorter in the transport direction than one of the blocks positioned downstream of the transport direction, and one of the blocks positioned at the center of the direction intersecting the transport direction is longer in the direction intersecting the transport direction than one of the block positioned in the direction apart from the center of the direction intersecting the transport direction.

8. An ink-jet printing method comprising:

providing an ink-jet printer device comprising a platen that supports a print medium while the print medium is transported in a medium transport direction, a plurality of heater blocks provided on the platen such that the heater blocks become smaller in width in a scanning direction toward both ends of the platen, and a print head that performs scanning in a direction intersecting the print medium transport direction and that ejects ink dots to the print medium to thereby perform printing on the print medium;

measuring a surface temperature of each of a plurality of portions of the print medium supported by the platen;

calculating an output value of each of the heater blocks for making the surface temperature of each of the plurality of portions of the print medium uniform based on the measured surface temperature; and controlling an output of each of the heater blocks based on the corresponding calculated output value.

9. A method according to claim 8; wherein the step of calculating comprises calculating a mean value of the surface temperature of the print medium for each of the heater blocks and calculating the output value of each of the heater blocks based on the corresponding calculated mean value.

10. An ink-jet printer comprising:

a print head that performs printing on a print medium transported in a print medium transport direction by scanning in a scanning direction intersecting the print medium transport direction;

a platen that supports the print medium while the print medium is transported along the print medium transport direction, the platen having a plurality of heater blocks that become smaller in width in the scanning direction toward both ends of the platen;

a measurement section that measures a surface temperature of each of a plurality of portions of the print medium supported by the platen;

a calculation section that calculates an output value of each of the heater blocks for making the surface temperature of each of the plurality of portions of the print medium uniform based on the surface temperature measured by the measurement section; and a heater temperature control section that controls an output of each of the heater blocks based on the output value calculated by the calculation section.

11. An ink-jet printer according to claim 10; wherein the measurement section is provided at a position near a center of a transport direction of the heater blocks arranged in the scanning direction.

* * * * *